United States Patent [19]

Torbeck

[11] 3,951,332

[45] Apr. 20, 1976

[54] CONTAINER CLOSURE WITH TUCK-UNDER TAB

[76] Inventor: Frank W. Torbeck, 8529 Concord Hills Circle, Cincinnati, Ohio 45243

[22] Filed: July 22, 1974

[21] Appl. No.: 490,901

[52] U.S. Cl. ..... 229/44 R; 229/48 SA; 229/51 TC; 229/51 TS; 229/DIG. 2

[51] Int. Cl.[2] ..... B65D 5/66

[58] Field of Search ..... 229/DIG. 2, 43, 44 R, 229/48 R, 51 TC, 51 SC, 37 R, 485 A, 485 B

[56] References Cited

UNITED STATES PATENTS

| | | | |
|---|---|---|---|
| 1,698,908 | 1/1929 | Cleveland | 229/48 R |
| 2,094,448 | 9/1937 | Evans | 229/44 R X |
| 2,713,454 | 7/1955 | Nute et al. | 229/51 TC |
| 2,874,891 | 2/1959 | Kelsall | 229/48 R X |
| 3,679,123 | 7/1972 | Wood | 229/43 |

*Primary Examiner*—William Price
*Assistant Examiner*—Stephen P. Garbe
*Attorney, Agent, or Firm*—Walter S. Murray

[57] ABSTRACT

A closure structure for containers, especially corrugated cases and boxes, wherein one outer closure flap is provided with a bodily reduced tab projected from its longitudinally extending edge portion, said tab being adapted to underlie the edge portion of a second outer closure flapin container closed position, whereby a single bond line of hot melt adhesive applied to the outer surfaces of the tab and aligned portions of the inner closure flaps serves when the second flap is pressed to closed position to secure together the outer and inner closure flaps.

Another aspect of the closure comprises crushing the tab on the one closure flap and the longitudinally extending edge portion of the second closure flap to provide square stacking with other cases having like closure structures.

4 Claims, 13 Drawing Figures

CONTAINER CLOSURE WITH TUCK-UNDER TAB

The present invention relates to container closures and is particularly directed to a novel heat sealable closure flap structure with a tuck-under tab especially adapted for corrugated boxes and cases and susceptible of being inexpensively produced on conventional case making machinery.

In standard packaging procedures the outer closure flaps of corrugated cases are secured to the inner closure flaps by a number of lines of adhesives or by a plurality of adhesive spots. Presently hot melt adhesives or thermoplastic materials are favored because they yield a quicker set and create stronger bonds and therefore require the application of less bonding material than do many ordinary wet or cold glues. The present case closures have first and second, coplanar outer closure flaps, a bodily reduced tuck-under tab being formed on and projecting laterally from the free end portion of said first closure flap to underlie the confronting free end portion of said second closure flap. Further the tab and the free end portion of the second closure flap are crushed to have reduced cooperative thicknesses to facilitate square stacking of cases provided with my closures. These closures therefore require, for top and/or bottom sealing procedures, but one narrow bond line of hot melt adhesive applied downwardly onto the outside surface of the tab while said first closure flap overlaps the inner closure flaps, said bond line also extending over aligned surface portions on the inner flaps exposed by the reduced tab whereby upon closing of the second closure flap all the flaps are secured together in closed condition by the one bond line of adhesive.

Other objects of the invention derived from my sealable closures having the foregoing characteristics are a precise and accurate quantity control of the hot melt for the closure structures whereby the ratio of adhesive usage to bond strength is greatly improved; a stronger case strength; an easily opened tear strip closure; and a closure particularly adapted to be opened for inspection or other purposes and having good reclosable features after the container has once been opened.

Other objects and features of the invention will become apparent from the following specification taken in conjunction with the accompanying drawings, wherein.

Figure 2:
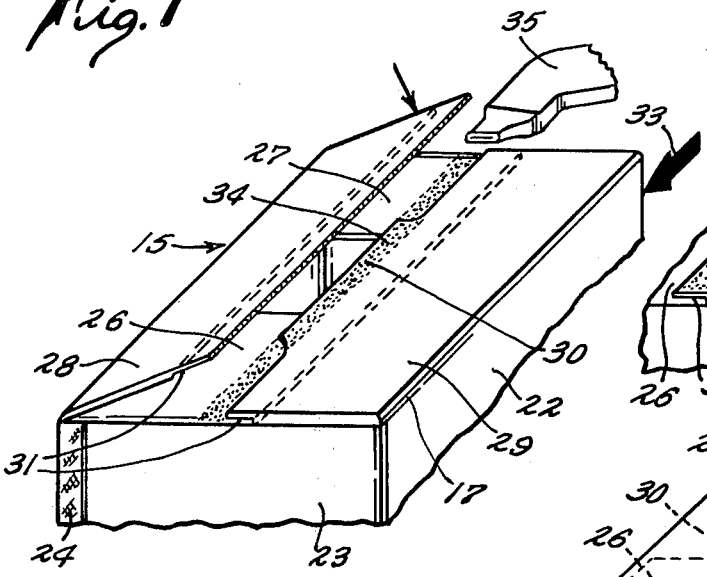
FIG. 2 is a fragmental, perspective view of the container formed from the blank illustrated in FIG. 1 with the closure in partially closed condition.
Figure 2A:
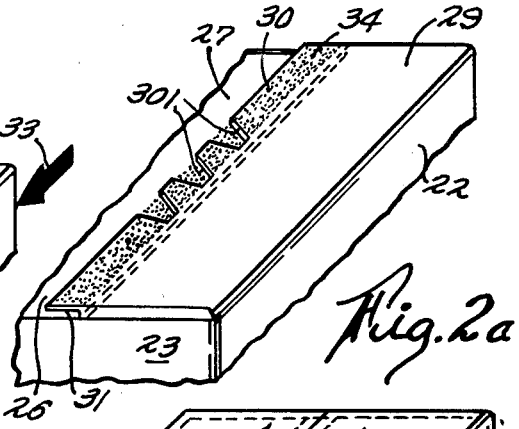

FIG. 2*a* is a fragmental view like FIG. 2 showing a modified form of closure.

Figure 1:
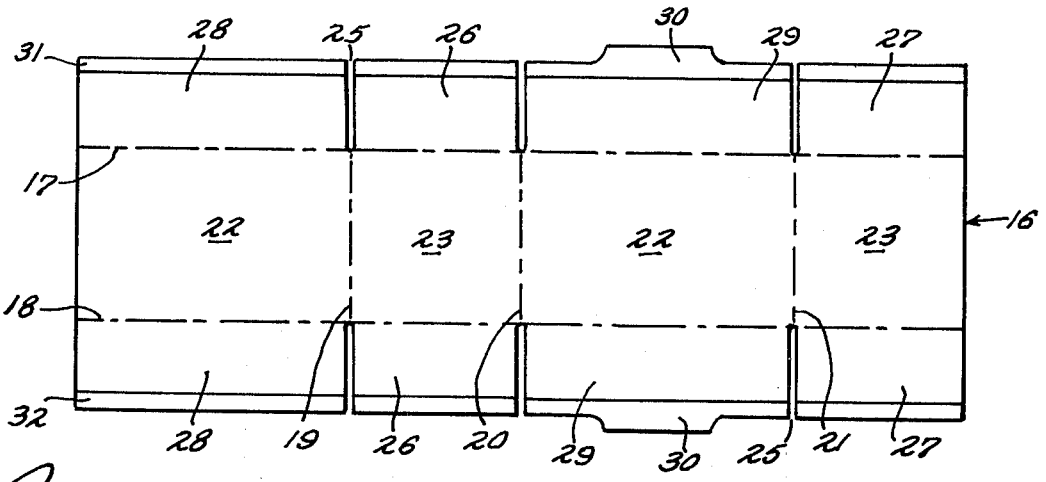
FIG. 1 is a plan view of a blank scored, slotted and having crush areas from which one form of the container closure of this invention is constructed.
Figure 3:
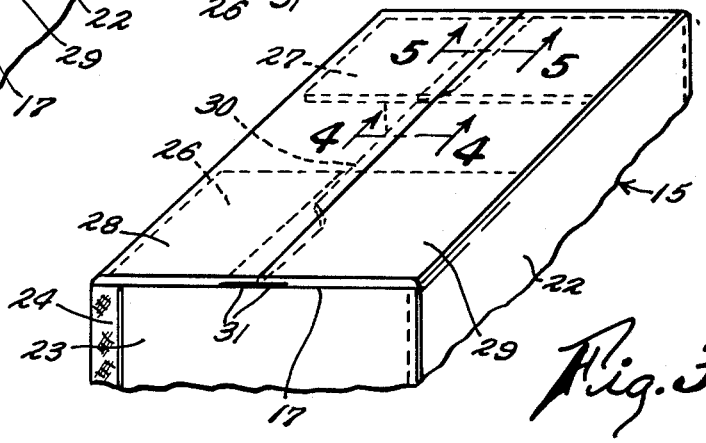

FIG. 3 is a fragmental section of the container shown in FIGS. 1 and 2 in a fully closed condition.

Figure 4:
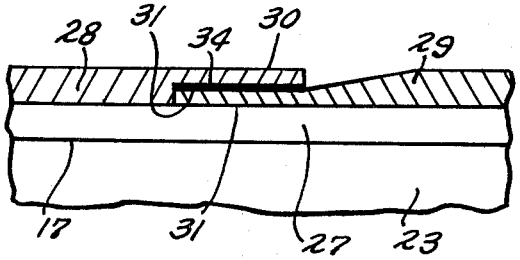

FIG. 4 is an enlarged section taken on line 4—4 of FIG. 3.

Figure 5:
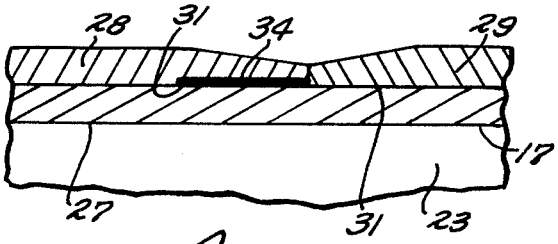

FIG. 5 is an enlarged section taken on line 5—5 of FIG. 3.

Figure 6:
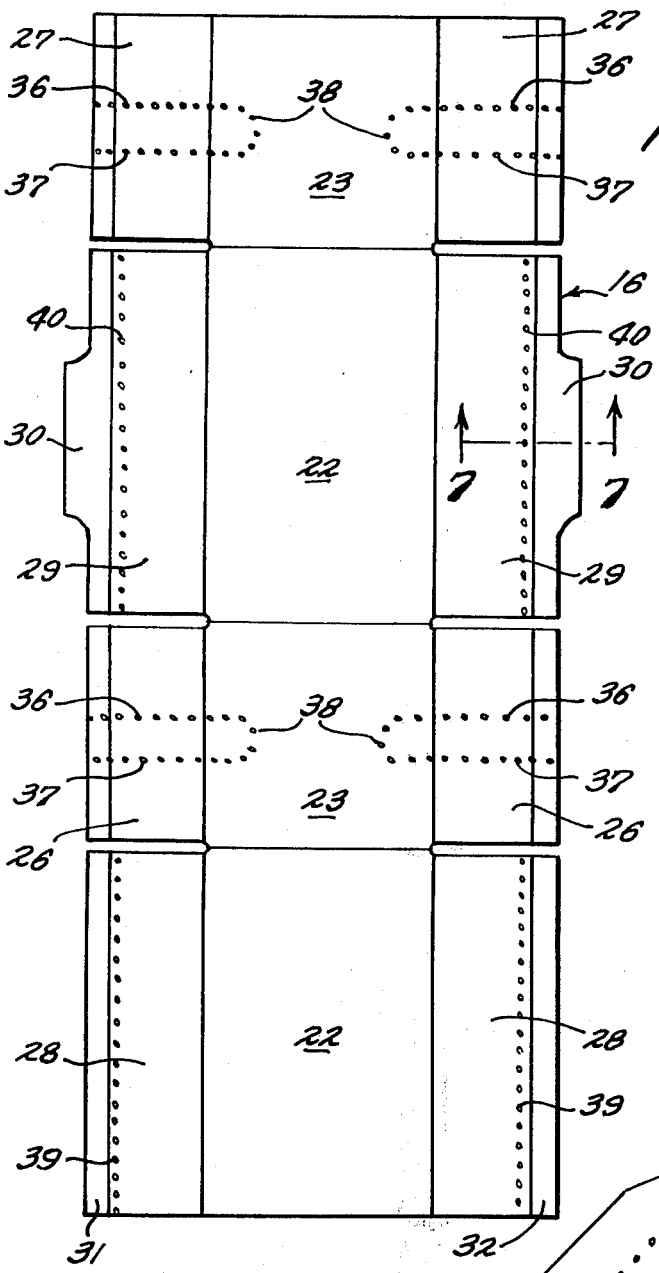

FIG. 6 is a plan view of another blank from which another form of the container closure of this invention is constructed.

Figure 7:
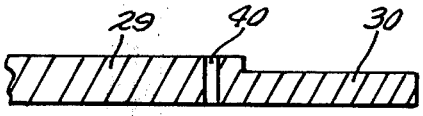

FIG. 7 is a greatly enlarged section taken on line 7—7 of FIG. 6.

Figure 8:
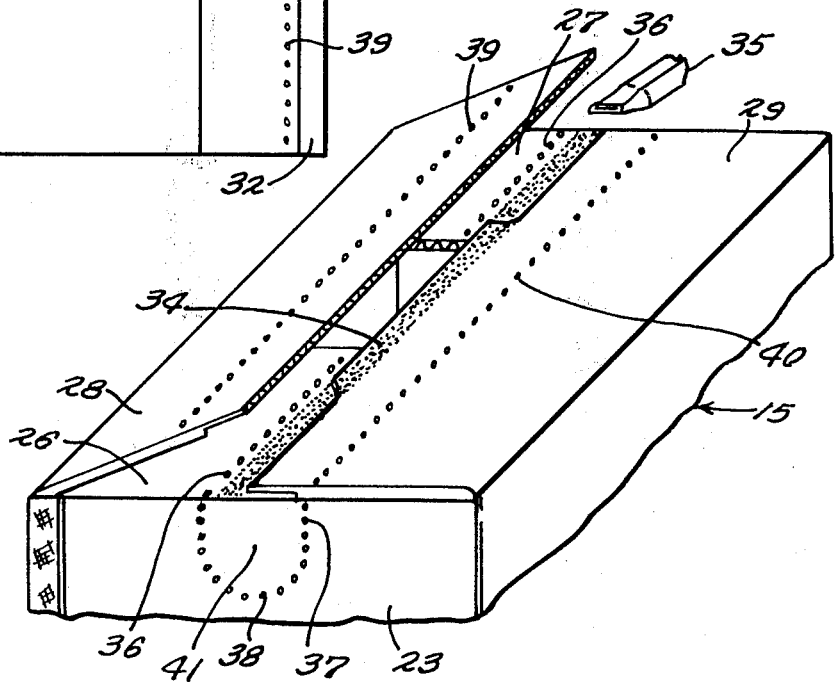

FIG. 8 is a fragmental, perspective view of the case formed from the blank illustrated in FIGS. 6 and 7 with the closure in partially closed condition.

Figure 9:
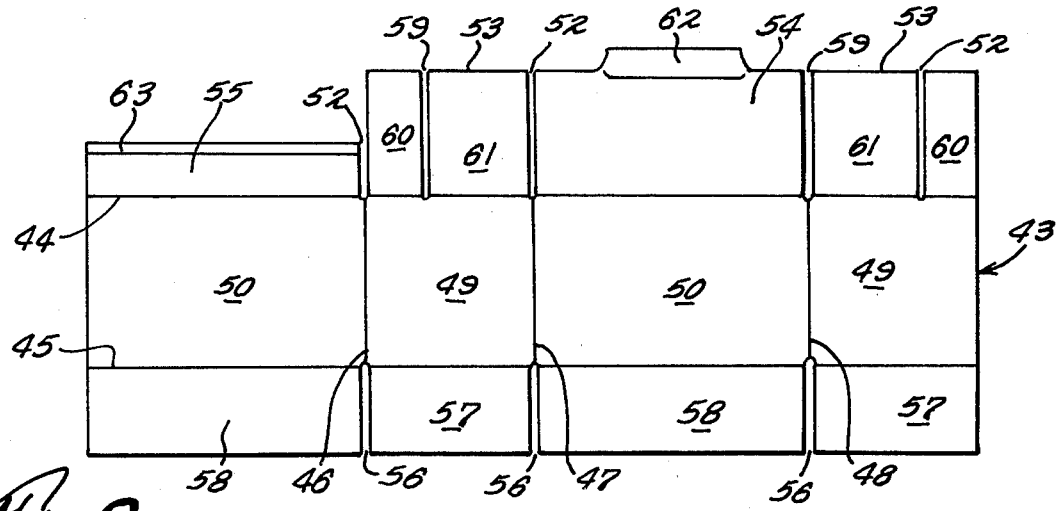

FIG. 9 is a plan view of still another blank from which a further form of the container closure of this invention is constructed.

Figure 10:
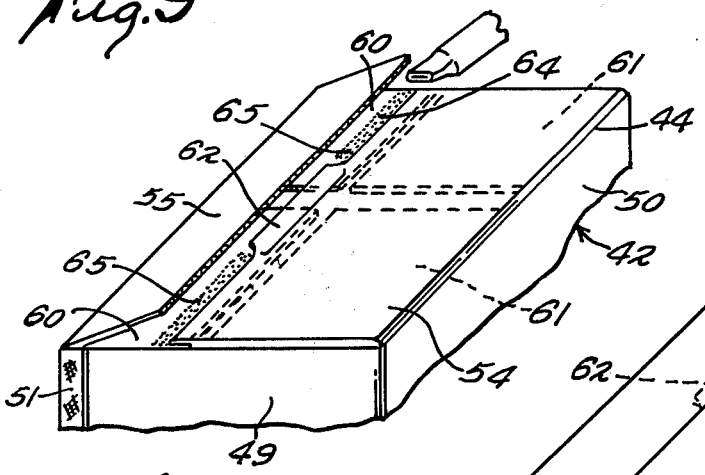

FIG. 10 is a fragmental, perspective view of the container formed from the blank illustrated in FIG. 9 with its closure in a partially closed condition.

Figure 11:
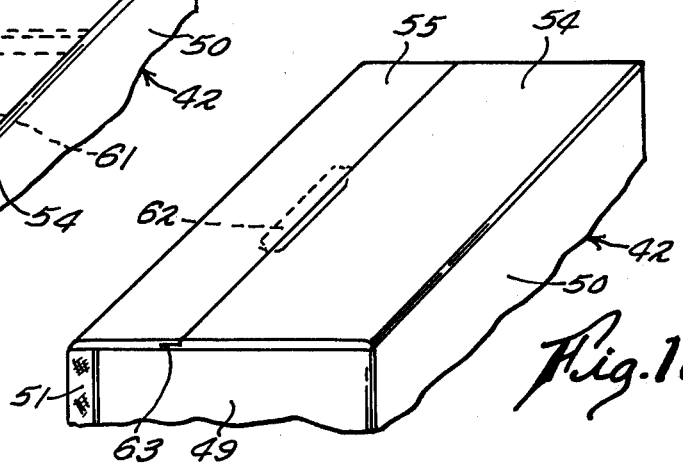

FIG. 11 is a fragmental, perspective view of the container shown in FIGS. 9 and 10 illustrated in closed condition.

Figure 12:
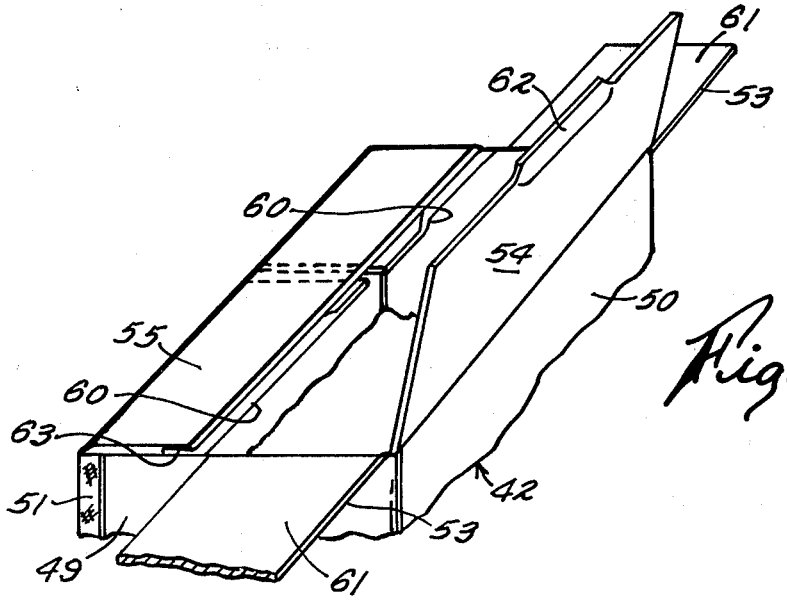

FIG. 12 is a fragmental, perspective view of the container of FIGS. 9–12 in opened, inspecting position.

Referring first to FIGS. 1–5 of the drawings there is depicted a container such as a standard case 15 made from a rectangular blank 16 preferably stamped from corrugated board. The blank is provided with two longitudinal blank folding score lines 17 and 18 and three lateral blank folding score lines 19, 20 and 21 which form opposed side walls 22—22 and opposed end walls 23—23 in the set up case 15, a manufacturers joint, such as an adhesive tape 24, being adapted to connect adjacent end and side walls together to close the case walls. The score lines 17 and 18 in conjunction with lateral slots 25 form opposed inner closure flaps 26—26 and 27—27 and opposed outer closure flaps 28—28 and 29—29 integral with and hinged on the blank, it being specifically noted that one set of first outer closure flaps 29—29 have foreshortened, body reducing tuck-under tabs 30 projecting from their central edge portions. The outer closure flaps 28 and 29 have longitudinally extending free edges which are in abutment in case closed positions whereby the tuck-under tabs 30 underlie the free marginal edge portions of the second outer closure flaps 28. Where square stacking becomes critical longitudinally aligned crushed margins 31 and 32 are formed in the edge portions of all the flaps and the tabs by means of conventional crush rollers under which the blank is conveyed during the blank forming process.

As the upper and lower closures for the case 15 formed from the blank 16 are identical only the top closure will now be described, it being understood that in some instances the bottom closure could be conventional in that the tab 30 on the outer flap 29 could be omitted and the flaps sealed closed in the usual manner. With specific reference to FIG. 2 of the drawings which illustrates a filled case being conveyed through the final closing step in the direction of the arrow 33, it will be seen that the inner closure flaps 26 and 27 have been hinged on the score line 17 into coplaner, confronting relationship across the top of the case and the first outer closure flap 29 with the tab 30 thereon has also been hinged on said score line 17 to overlie the inner flaps 26 and 27. While the second outer closure flap 28 is in an almost closed position a narrow bond line of hot melt adhesive 34 is applied downwardly onto the moving case 15 by a stationary nozzle 35, said bond line covering the entire outer surface of the bodily reduced tab 30 and the aligned narrow longitudinally extending surface portions of the inner flaps 26 and 27 exposed by the body reduction of the tab. Next the flap 28 is hinged downwardly into a coplanar position with the flap 29 and the longitudinal crushed margin of flap 28 is pressed against the bond line whereby all the flaps are sealed closed by said bond line of adhesive 34.

Now with reference to FIG. 2*a* of the drawings the body of the tab 30 has been reduced in area by forming a series of notches 301 therein whereby the outer surfaces of the inner closure flaps 26 and 27 are exposed to receive with the tab 30 a single bond line of adhesive 34. It is contemplated that the tab body 30 could be reduced in area by other means such as punched out holes, and the like.

With particular reference to FIGS. 3, 4 and 5 of the drawings depicting the closure in sealed condition it will be noted that the crushed tab 30 on the first outer closure flap 29 underlies and is secured to the central portion of the crushed area 31 on the second outer closure flap 28 by the bond line of adhesive 34, that the free edges of the outer closure flaps 28 and 29 are in abuting relationship on each side of the tab 30 and that the crushed area on the second outer flap 28 on each side of the tab 30 are secured to the inner closure flaps 26 and 27 by the same bond line of adhesive 34, thus providing a strong sealed closure with a single bond line of adhesive and a closed case for square stacking with similarly constructed cases.

As seen in FIGS. 6–8, inclusive, of the drawings the blank 16 is modified to provide a tear opened closure for the top and/or bottom of the case 15 and to this end a pair of laterally extending lines of perforations 36 and 37 are formed in each of the opposed inner closure flaps 26—26 and 27—27 of the blank, said pairs of perforations 36 and 37 continuing a short distance into the adjacent side walls 23—23 and having their inner terminal ends connected by curved lines of perforations 38—38 formed in said side walls. Longitudinal lines of perforations 39 and 40 are formed in the opposed outer flaps 28—28 and 29—29, respectively, that are parallel to and spaced inwardly from the crushed areas 31 and 32 on said flaps. As clearly seen in FIG. 8 of the drawings after the narrow bond line of adhesive 34 has been applied to the flaps and the case closed the lines of perforations 39 and 40 on the outer flaps 28 and 29, respectively, will overlay and be in registry with the pair of perforated lines 36 and 37, respectively, on the inner flaps 26 and 27. The portions of the lines of the perforations 36 and 37 which extend into the side walls 23—23 and joined by curved perforated lines 38 form a thumb engaging area 41 (FIG. 8) which upon inward manual pressure exerted thereon will rupture thereby providing a hand hold for tearing away the entire areas of the flaps located between the perforations to open the case.

Now with reference to FIGS. 9–12 of the drawings a standard case 42 is constructed from a rectangular blank 43 provided with two longitudinal blank folding score lines 44 and 45 and three lateral blank folding score lines 46, 47 and 48 which form opposed side walls 49—49 and opposed end walls 50—50 in the set up case 42, an adhesive tape 51, or the like joint, being adapted to connect an adjacent end and side wall together to close the case walls. The score line 44 and lateral slots 52 form relatively wide inner closure flaps 53—53, a first wide outer closure flap 54 and a relatively narrow second outer closure flap 55. The score line 45 with lateral slots 56 form inner flaps 57—57 and outer flaps 58—58 having the same standard widths. The wide inner flaps 53—53 are each optionally provided with a lateral slot 59 which divides each of said inner flaps into independent sections 60 and 61. An optionally crushed tab 62 is formed on the wide outer flap 54 while the narrow outer flap 55 has an optionally crush line 63 formed in its free marginal edge portion.

With reference to FIG. 10 of the drawings it will be noted that the narrow bond line of adhesive 64 is interrupted in order that adhesive portions 65—65 are applied to the sections 60—60 of the wide inner flaps 53—53, and that upon closing of the outer flaps onto the inner flaps only the sections 60—60 of the inner flaps 53—53 are secured to the inner side of the narrow outer flap 55. The tuck-under tab 62 on the wide outer flap 54 is held under the free marginal edge portion of the narrow outer flap 55 between the adhesive connections, and as indicated in FIG. 11 of the drawings, the tab 62 underlies the crushed margin 63 on the narrow outer tab 55.

To open the case 42 it is only necessary to lift up on the wide outer flap 54 which releases the tuck-under tab and moves it into the position shown in FIG. 12 and thereafter to open out the sections 61—61 of the inner flaps 53—53 and attain access to the case contents for inspection or other purposes, the sections 60—60 of the inner flaps 53—53 remaining in closed position adhesively secured to the narrow outer flap 55. The case can be reclosed by reversing the opening procedure.

In all forms of the invention depicted in the drawings each closure has a pair of outer closure flaps which are coplanar in closed positions, a bodily reduced tuck-under tab being formed on the longitudinal edge portion of one outer flap to expose outer surface portions of the inner closure flaps. A single bond line of adhesive is applied to the outer face of the tab and exposed surfaces of the inner closure flaps whereby in a closed position the tab underlies and is secured to the longitudinal edge portion of the opposed outer closure flap, said bond line also securing the said other outer closure flap to the inner closure flaps.

What is claimed is:

1. In a set-up, sealed container formed from a blank having lateral score lines to form opposed interconnected side and end walls, said blank having a longitudinal score line to define first and second outer closure flaps on the container side walls and inner closure flaps on the container end walls, slots formed between adjacent closure flaps permitting the inner closure flaps to be hinged towards each other to lie in a common plane with their longitudinal edges in confronting relationship and the first and second outer closure flaps to be hinged towards each other to lie in a common plane upon the inner closure flaps with their longitudinal edges in abutting relationship; a tuck-under tab formed on the first outer closure flap and projecting from the central longitudinal edge portion of said first outer flap and to overlap the longitudinal edge portions of the inner closure flaps, and a single, straight bond line of adhesive on the outer surface of the tab and aligned outer surface portions of the inner closure flaps on each side of the tuck-under tab whereby the tab underlies and is adhered to the longitudinal end portion of the second outer closure flap and the second closure flap is adhered to the inner closure flaps.

2. A closure structure for containers as set forth in claim 1 wherein lines of perforations are formed in the outer flaps parallel to and spaced laterally inwardly from the longitudinal edges of said outer flaps, and each inner closure flap has a pair of parallel perforations formed centrally thereof which are joined at the folding score line of the blank by an arcuate perforation formed in the end wall, the said lines of perforations in all the flaps being in registry in container closed positions.

3. A set-up, sealed container as set forth in claim 1 wherein the longitudinal edges of the inner closure flaps are in spaced, confronting relationship and the tuck-under tab bridges the space between said longitudinal edges of the inner closure flaps.

4. A set-up, sealed container as set forth in claim 3 wherein the single, straight bond line of adhesive is substantially as wide as the width of the tuck-under tab.

* * * * *